United States Patent [19]

Kato et al.

[11] 4,212,121

[45] Jul. 15, 1980

[54] METHOD AND APPARATUS FOR DREDGING HAVING BOW-STERN MOVEMENT OF THE SUCTION MEANS

[75] Inventors: Masao Kato, Tokyo; Kosuke Kishida, Ichikawa, both of Japan

[73] Assignee: Mitsubishi Jukogyo Kabushiki Kaisha, Tokyo, Japan

[21] Appl. No.: 929,813

[22] Filed: Jul. 31, 1978

[51] Int. Cl.[2] ..... E02F 3/92

[52] U.S. Cl. ..... 37/58; 37/195

[58] Field of Search ..... 37/58, 64–67, 37/73, 195

[56] References Cited

U.S. PATENT DOCUMENTS

| | | | |
|---|---|---|---|
| 3,253,357 | 5/1966 | Allard | 37/65 |
| 3,579,872 | 5/1971 | Jantzen | 37/66 |

FOREIGN PATENT DOCUMENTS

| | | | |
|---|---|---|---|
| 6803487 | 9/1969 | Netherlands | 37/195 |

*Primary Examiner*—Clifford D. Crowder

*Attorney, Agent, or Firm*—Wenderoth, Lind & Ponack

[57] ABSTRACT

An improved method for dredging by means of a pair of spuds provided on the respective sides of the stern of a dredger and adapted to be alternately driven into the bottom of the water, a ladder projected from the bow portion of the dredger and a suction port member that is mounted at the extreme end portion of the ladder. The improvements are in the repetitive cycles of operation, each consisting of the steps of at first dredging while the suction port member is successively retracted from the foremost position of its stroke to the rearmost position as the ladder is swinging from one side towards the other about the spud on the other side, then driving the spud on the one side and retracting of the spud on the other side, advancing the suction port member to the middle position in its stroke, thereafter dredging as the ladder is swinging towards the one side, then advancing the suction port member to the foremost position of its stroke, and thereafter again dredging as the ladder is swinging from one side towards the other side. Preferable structures of a dredging apparatus to be used in the above method are also disclosed.

3 Claims, 9 Drawing Figures

METHOD AND APPARATUS FOR DREDGING HAVING BOW-STERN MOVEMENT OF THE SUCTION MEANS

The present invention relates to a method for dredging that is suitable for dredging of mud and sludge, and a dredging apparatus to be used in the method.

Figure 1:
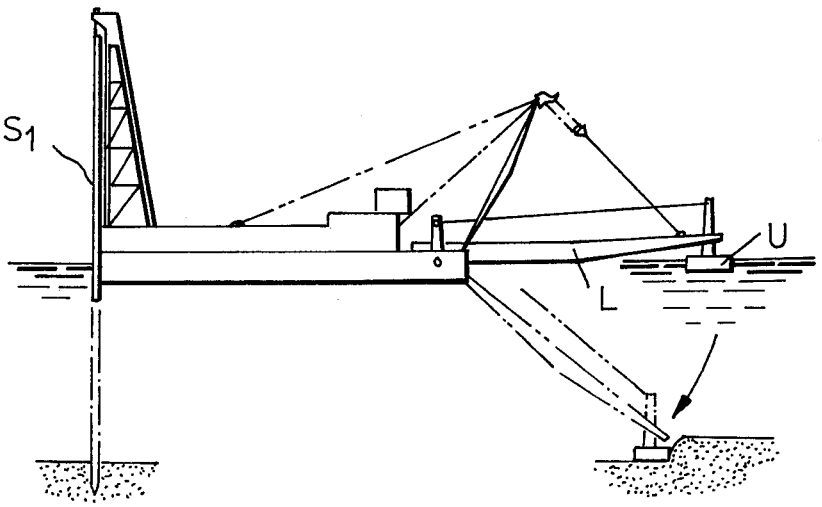

In the method for dredging mud and sludge commonly employed in the prior art, the dredging is carried out in the following manner by making use of a dredger as illustrated in FIG. 1 (a side view) and FIG. 2 (a plan view).

That is, in the dredging operation, except for the period when spuds $S_1$ and $S_2$ provided on the starboard and port, respectively, of the stern are alternately driven into the bottom, only one spud on either the starboard or the port is driven into the bottom, and the dredging is carried out by sucking and conveying the mud and sludge through a suction port member U provided at the extreme end of a ladder L while the ladder L is swinging (rotating in the left and right directions) jointly with the hull about the driven spud. These swinging motions are achieved by winding up one of two swing wires $J_1$ and $J_2$ on the starboard and the port having anchors (not shown) at their extreme ends with a swing winch M, while paying out the other swing wire.

Figure 3:
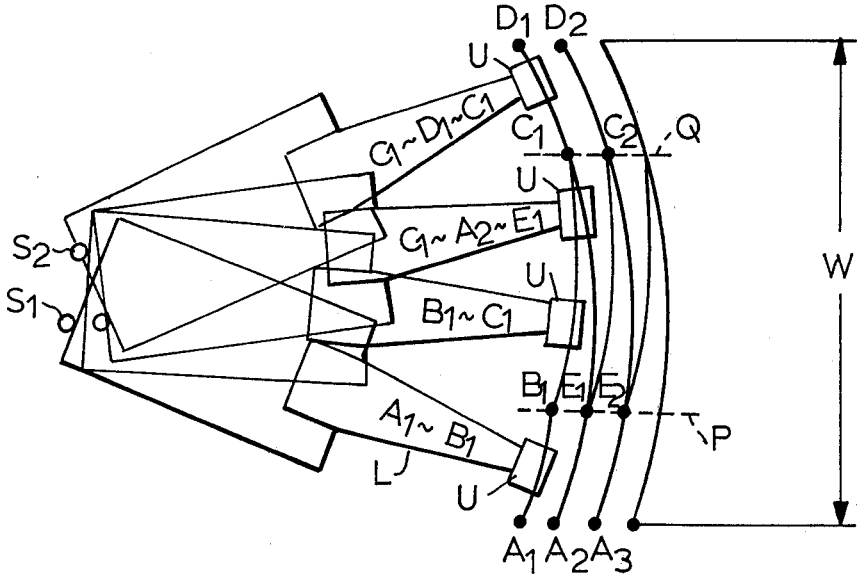

In dredging operations where only the uppermost layer of mud and sludge (the depth of mud and sludge equivalent to the height of the suction port) is dredged, the operations are carried out, for example, by using the starboard spud $S_1$ as a working spud and the port spud $S_2$ as an advancing spud, as illustrated in FIG. 3.

At first, starting from the rightmost position $A_1$ on the starboard in FIG. 3, the starboard spud $S_1$ is driven and the port spud $S_2$ is raised. Under such a condition, if a leftward swing is effected, then suction port member U at the extreme end of the ladder moves from the position $A_1$ to the position $B_1$ while tracing an arc-shaped locus having its center at the working spud $S_1$ on the starboard.

At the position $B_1$, the swing motion is stopped, and after the raised port spud $S_2$ has been driven, the driven spud $S_1$ is drawn up alternate. This operation is called reversal of the spuds. Next, when a leftward swing is effected, the suction port member U moves from the position $B_1$ to the position $C_1$ while tracing an arc-shaped locus having its center at the advancing spud $S_2$ on the port. During this period, the hull is advanced approximately the length of the side opening in the stern-bow direction of the suction port member U.

Then at the position $C_1$ the swing motion is stopped, and reversal of the spuds is effected.

Thereafter, when a leftward swing is effected, the suction port member U moves from the position $C_1$ to the position $D_1$, and the locus traced by the suction port member U during this period forms a part of an arc having its center at the starboard spud $S_1$. When the suction port member U has reached the leftmost position $D_1$ on the port, the swing motion is stopped, and the motion is switched to a rightward swing motion.

Subsequently, as the rightward swing is effected, the suction port member U moves from the position $D_1$ through the positions $C_1$ and $E_1$ to the position $A_2$.

The locus traced by the suction port member U during this period forms a part of an arc having its center at the starboard spud $S_1$.

The direction of swing motion is switched at the position $A_2$, and the subsequent sequence of operations is the same as the above-described sequence starting from the position $A_1$.

More particularly, the sequence is such that between the positions $A_2$ and $E_1$ is effected a leftward swing about the starboard spud $S_1$, and after reversal of the spuds has been effected at the position $E_1$, in the interval between the positions $E_1$ and $C_2$ the suction port member D is advanced while effecting a leftward swing about the port spud $S_2$, at the position $C_2$ is effected reversal of the spuds, in the interval between the positions $C_2$ and $D_2$ is effected a leftward swing about the starboard spud $S_1$, and after the direction of the swing has been switched at the position $D_2$, a rightward swing is carried out about the starboard spud $S_1$ from the position $D_2$ through the positions $C_2$ and $E_2$ to the position $A_3$.

By repeating the aforementioned sequence of operations, the hull is intermittently advanced while continuing the dredging work.

When dredging mud and sludge, it is desirable to continuously dredge a high concentration of mud and sludge that is approximately in the state of the bottom of the body of water. For that purpose it is necessary to provide an apparatus in which only mud and sludge are sucked through a mud and sludge inlet opening on the side surface of the suction port member U so that excessive water will not be sucked.

Taking into consideration the aforementioned requirement, we will reconsider the above-described sequence of dredging operations illustrated in FIG. 3. The rate of filling of the mud and sludge inlet opening by the mud and sludge is termed the dredging efficiency, and the relation between the dredging efficiency and the positions of the suction port member U in the sequence of dredging operations, is diagrammatically shown in FIG. 4.

In the dredging work, the shifts of the position of the suction port member U from $A_1 \rightarrow B_1 \rightarrow C_1 \rightarrow D_1 \rightarrow C_1 \rightarrow E_1 \rightarrow A_2$ are repeated, and so, only one cycle of the operations from the position $A_1$ to the position $A_2$ need be investigated. The locus of the suction port member U between the positions $A_1$ and $B_1$ is the same as the locus between the positions $A_2$ and $E_1$ in the preceding cycle where the mud and sludge have been already dredged, so that the dredging efficiency is equal to 0% in this interval. During the period when the spuds are being reversed while the swing of the suction port member U is stopped at the position $B_1$, is also the dredging efficiency is also equal to 0%. During the period when the suction port member U moves from the position $B_1$ to the position $C_1$, the dredging efficiency is gradually increased from 0% to 100%, but during the period when the spuds are being reversed at the position $C_1$, the dredging efficiency remains at 0%.

The dredging efficiency is equal to 100% between the positions $C_1$ and $D_1$, but during the period when the direction of swing motion is being reversed at the position $D_1$, it is equal to 0%.

Figure 4:
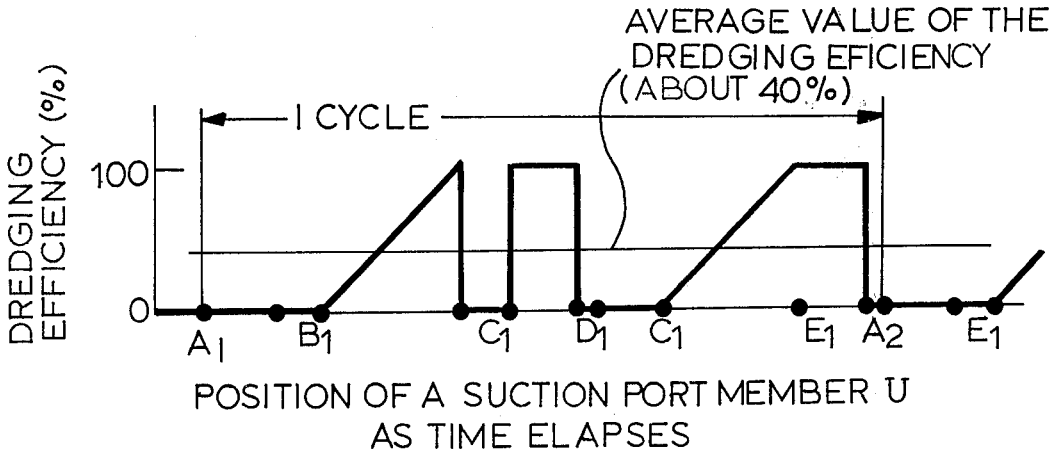

Between the positions $D_1$ and $C_1$, since dredging has been already finished, the dredging efficiency is equal to 0%, and as the suction port member D moves from the position $C_1$ to the position $E_1$, the dredging efficiency is gradually increased from 0% to 100%. Between the positions $E_1$ and $A_2$ the dredging efficiency is equal to 100%, but during the period when the direction of swing motion is being reversed at the position $A_2$ the dredging efficiency is equal to 0%. FIG. 4 shows the mode of variation of the dredging efficiency during the above-described one cycle.

It is to be noted that in FIG. 3, reference characters P and Q designate the positions where the spuds are reversed, and reference character W designates the width of dredging.

As described above, in the prior art method, since the suction port member U passes through the area where dredging has been already finished such as the intervals between the positions $A_1$ and $B_1$ and between the positions $D_1$ and $C_1$, the suction port member U may possibly suck only sea water without sucking any mud and sludge (the dredging efficiency then being 0%), or else, in certain areas such as the intervals between the positions $B_1$ and $C_1$ and between the positions $C_1$ and $E_1$, as the swing motion proceeds, gradually an increased rate of mud and sludge is sucked, but at the same time a large amount of water is also sucked in, and consequently, the average value of the dredging efficiency is as low as about 40%.

In the dredging method in the prior art, since a large amount of excessive water is sucked in, the prior art method has the disadvantages that the amount of mud and sludge (the mud and sludge in the state of the bottom of the water) dredged per unit time is reduced, that upon discharging the excess sucked water, processing of a large amount of water is necessitated for preventing public nuisance, and that the amount of fluid transported is increased by the amount of the excess sucked water.

The present invention seeks a solution to the aforementioned problems associated with the dredging of mud and sludge.

It is one object of the present invention to provide a novel method for dredging in which the dredging can be achieved efficiently without sucking excessive water during dredging.

Another object of the present invention is to provide a novel dredging apparatus having an excellent performance to be used in said novel method.

According to one feature of the present invention, there is provided a method for dredging, in which a pair of spuds provided on the respective end of the stern of a dredger are alternately driven into the bottom of a body of water, and while swinging a ladder projecting from the bow portion of the dredger jointly with the hull about the spud driven into the bottom, dredging is effected through a suction port member that is mounted at the extreme end portion of said ladder so as to be movable in the back and forth directions; characterized in that said dredging is effected by repeating the operations each consisting of the steps of at first dredging while said suction port member is successively retracted from the foremost position of its stroke to the rearmost position as said ladder is swinging from one side towards the other side about the spud on said the other side, then driving the spud on said one side into the bottom and retracting the spud on said the other side, advancing said suction port member to the middle position in its stroke, thereafter dredging as said ladder is swinging towards said one side, then advancing said suction port member to the foremost position of its stroke, and thereafter again dredging as said ladder is swinging from said one side towards said the other side.

According to another feature of the present invention, there is provided a dredging apparatus to be used in the above-described method, characterized in that said apparatus comprises a ladder projecting from the bow portion of a hull so that it be freely inclined up and down, a movable frame supported on the extreme end portion of the ladder so as to be rotatable about a horizontal lateral axis, and a suction port member for dredging held on said movable frame so as to be movable in the back and forth directions, and that said suction port member is mounted on a truck that is movable in the back and forth directions within said movable frame.

According to still another feature of the present invention, the above-described dredging apparatus is modified in that said suction port member for dredging is pivotably mounted to the bottom end of a parallel link mechanism that is pivotably mounted on said movable frame so as to be rockable in the back and forth directions.

Figure 2:
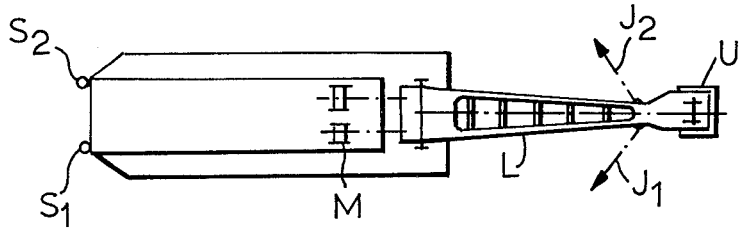
Figure 5:
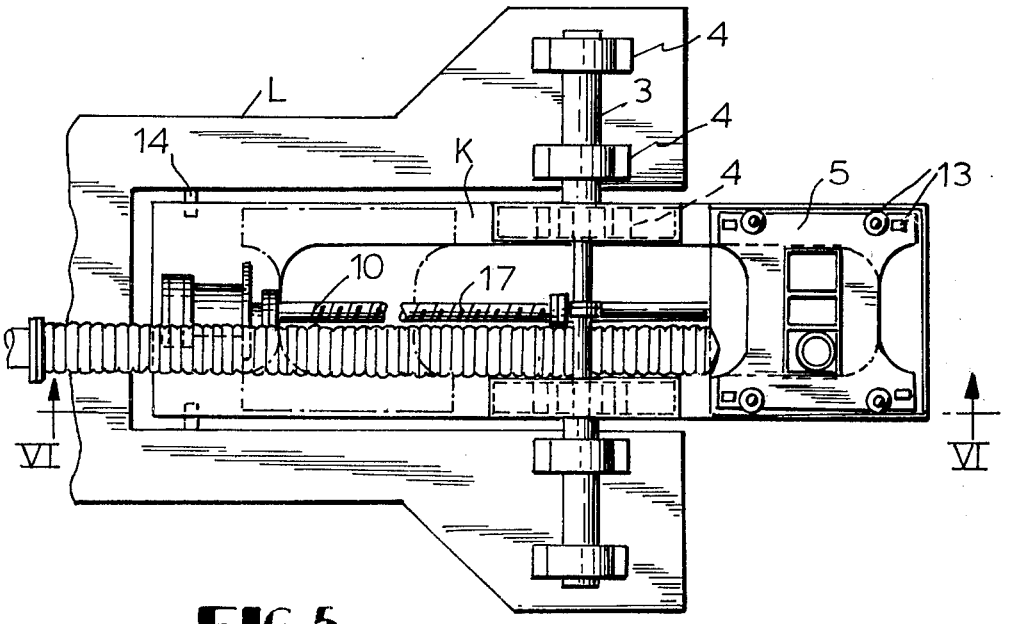
Figure 6:
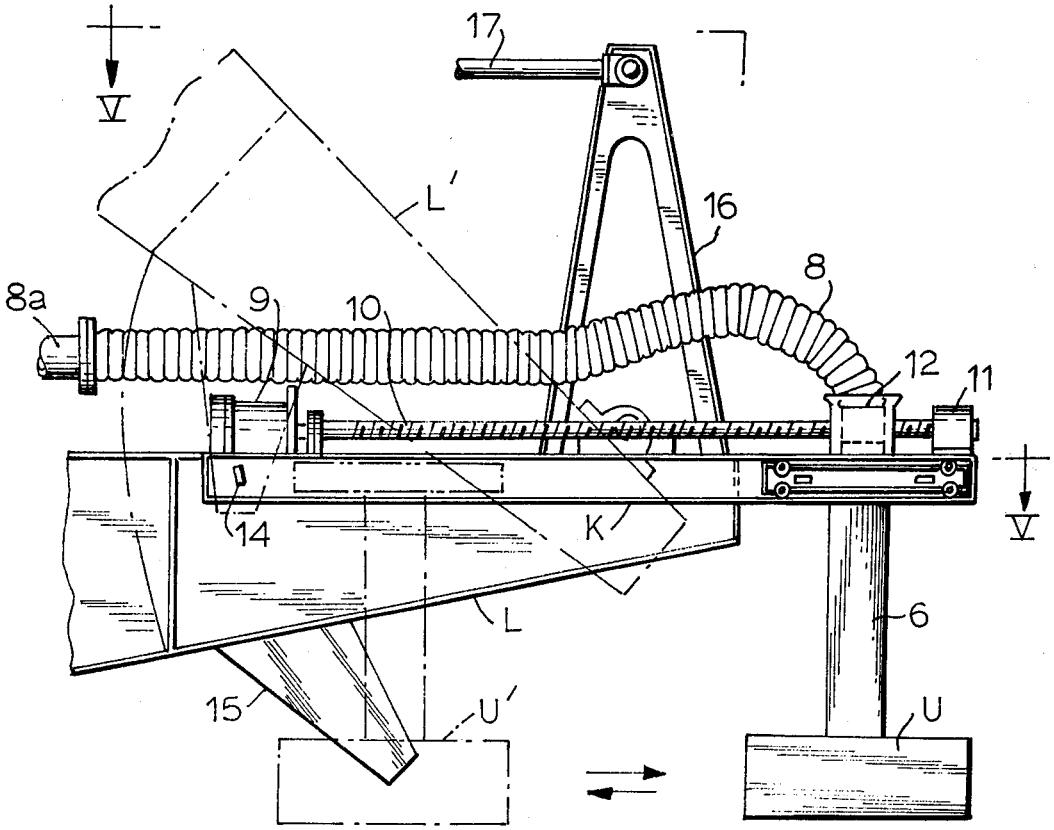
Figure 7:
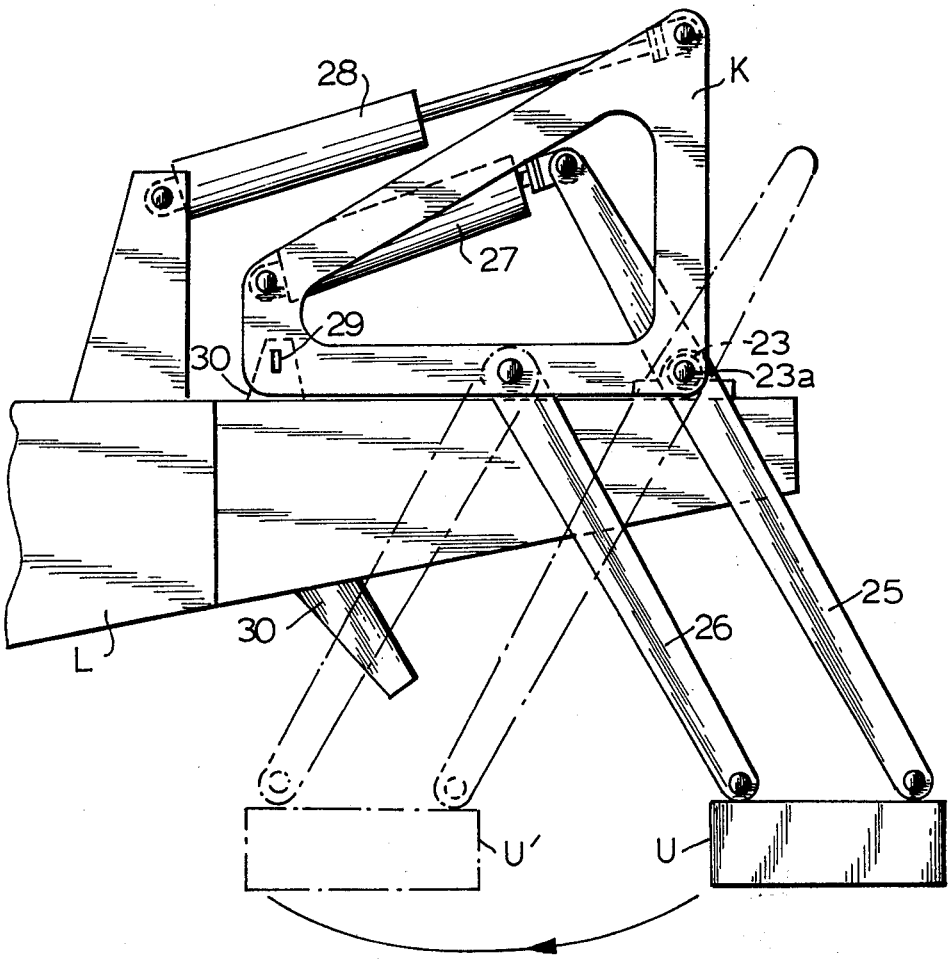
Figure 8:
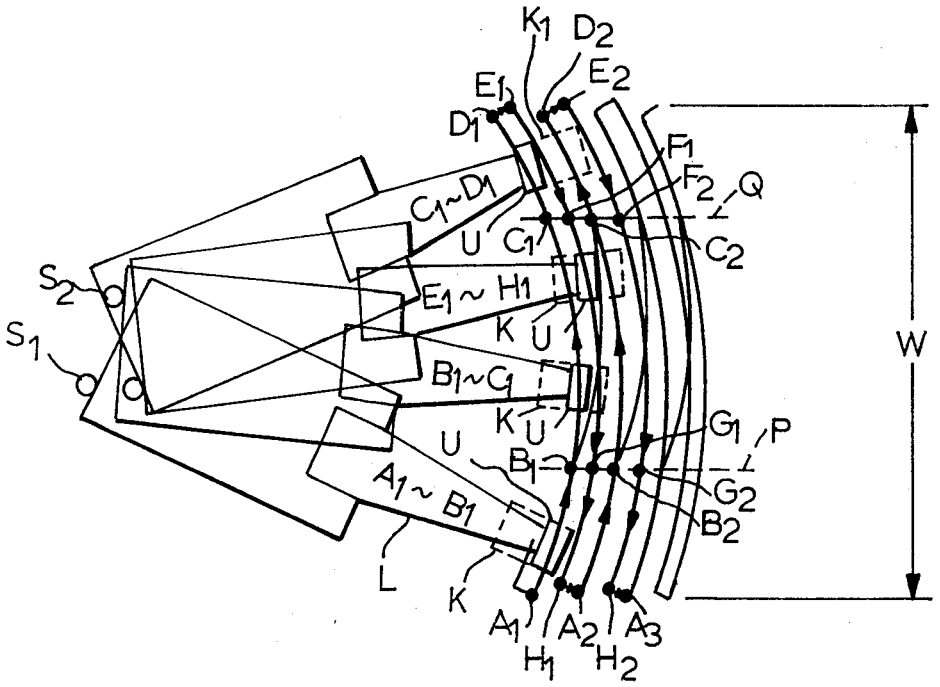
Figure 9:
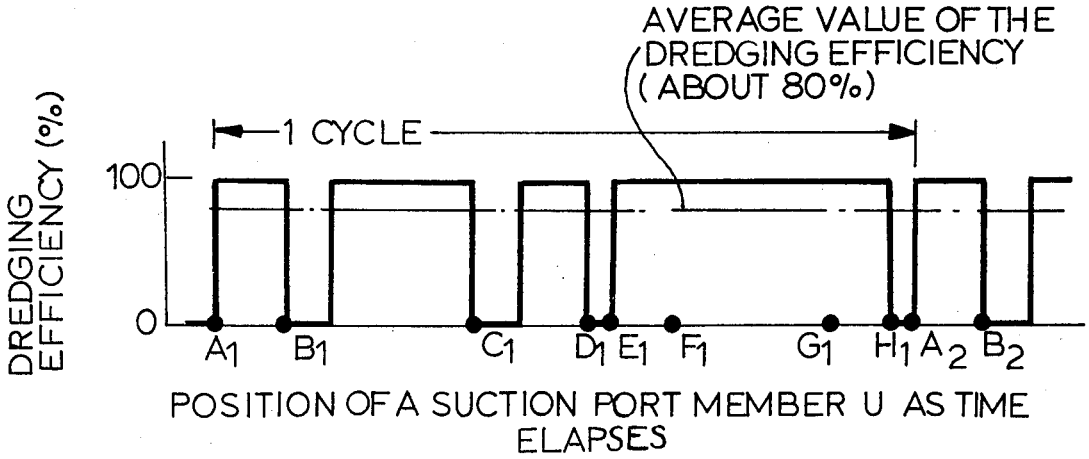

Above-described and other features and objects of the present invention will become more apparent by reference to the following description taken in conjunction with the accompanying drawings, in which:

FIGS. 1 and 2 show a prior art dredger equipped with a dredging apparatus, FIG. 1 being a side view, and FIG. 2 being a plan view, FIG. 3 is a diagrammatic view for explaining a method for dredging with the prior art dredger, FIG. 4 is a diagram showing the characteristics of the method for dredging according to the prior art, FIGS. 5 and 6 show a dredging apparatus according to a first preferred embodiment of the present invention, FIG. 5 being a plan view taken along line V—V in FIG. 6 as viewed in the direction of the arrows, and FIG. 6 being a side view taken along line VI—VI in FIG. 5 as viewed in the direction of the arrows, FIG. 7 is a side view showing a dredging apparatus according to a second preferred embodiment of the present invention, FIG. 8 is a diagrammatic view for explaining a method for dredging according to the present invention, and FIG. 9 is a diagram showing the characteristics of the method for dredging according to the present invention.

The dredging apparatus to be used in the method according to the present invention is principally characterized in that the suction port member U for mud and sludge which is provided at the extreme end of the ladder L shown in FIGS. 1 and 2 is movable in the bow-stern directions.

A first preferred embodiment of the present invention is illustrated in FIGS. 5 and 6, in which a movable frame K is hinged to the extreme end portion of a ladder L by a shaft 3 and bearings 4, so that the movable frame K is rotatable about this shaft 3. On the movable frame K is provided a traveling truck 5 which is movable in the bow-stern directions, and to this travelling truck 5 is fixedly secured a suction port member U for mud and sludge by means of a coupling member 6.

Within the coupling member 6 is disposed a piping system for transporting and discharging the mud and sludge collected by the suction port member U for mud and sludge, a flexible pipe 8 is connected to the top end of this piping system, and the other end of the flexible pipe 8 is connected to a pipe 8*a* which is led to the suction port of a mud and sludge dredging pump not shown.

On the movable frame K are mounted a hydraulic motor 9, a threaded rod 10, a thrust bearing 11 and an internally threaded rod receiver 12 threadedly mounted on the rod 10, and by rotating the hydraulic motor 9 in the normal and reverse directions, the mud and sludge suction port member U can be driven in the bow-stern directions by the rod 10, rod receiver 12 and coupling member 6. The hydraulic motor 9 can be replaced by an electric motor, and depending upon the rotational speed of the hydraulic motor 9, if necessary, a reduction gear could be interposed between the hydraulic motor 9 and the rod 10. It is to be noted that guide rollers 13 provided on the truck 5 could be replaced by sliders made of fluorine group synthetic resin having a low coefficient of friction.

In FIG. 5, reference numeral 14 designates rollers for receiving a lateral reaction force exerted upon the suction port member U by the mud and sludge, in cooperation with the shaft 3. In addition, reference numeral 15 in FIG. 6 designates guide plates for the rollers 14, reference numeral 16 designates a coupling pedestal of a leveling device for always holding the suction port member U in a horizontal state, and reference numeral 17 designates a coupling rod.

The above-described leveling device carries out leveling control for the suction port member U by means of a hydraulic cylinder (not shown) having one end connected to the coupling rod 17 and the other end connected to the ladder L in response to a signal issued by a level detector (not shown) disposed on the movable frame K.

Alternatively it is also possible to extend the connection rod 17 to form a hinged parallelogram structure as shown in FIG. 1 jointly with the ladder L and thereby the suction port member U is controlled to maintain a horizontal attitude regardless of the inclination of the ladder L.

In FIG. 6, reference character U' designates the suction port member shifted to the stern position, and reference character L' designates the ladder positioned for working at substantially the maximum dredging depth.

A second preferred embodiment of the dredging apparatus to be used in the method according to the present invention is illustrated in a side view in FIG. 7, in which at the extreme end portion of the ladder L is hinged a movable frame K on a shaft **23*a* in bearings 23, so that this movable frame K is rotatable about the shaft 23*a***.

In addition, at the bottom ends of mounting legs 25 and 26 which are pivotably mounted on the movable frame K at their top ends is pivotably supported a suction port member U by pin couplings to form a parallel link mechanism, and in order to always maintain the suction port member U in a horizontal state, the four coupling pins are at the corners of a parallelogram.

To the top end of the mounting leg 25 is connected a hydraulic cylinder 27 for shifting the suction port member U back and forth, and the construction is such that the suction port member U be shifted in the bow-stern directions by extending and retracting the piston rod of this hydraulic cylinder 27.

While FIG. 7 shows the ladder L held in a horizontal state, during dredging work in order to lower the suction port member U to the bottom of the body of water, the ladder L is inclined depending upon the dredging depth until the angle formed between the ladder L and the horizontal level is increased to about 45° at the maximum. In order to still maintain the suction port member U in a horizontal attitude even in such an inclined position of the ladder L, it is necessary to rotate the movable frame K depending upon the inclination angle, and to that end a leveling cylinder 28 is provided. The extension and contraction of this cylinder 28 can be controlled by a signal issued from a level detector (not shown) mounted on the movable frame K.

In addition, guide rollers 29 for transmitting the force exerted by the suction port member U on the ladder L in cooperation with the shaft **23*a* and bearings 23, are provided on the movable frame K, and guide plates 30 for the guide rollers 29** are provided on the ladder L.

It is to be noted that according to the second preferred embodiment, when the suction port member U is located at the middle position in its stroke, the vertical position of the suction port member U is somewhat lower than when the suction port member U is located at a forward position or a rear position, but this can be compensated for by moving the ladder L a little in the vertical direction.

Now, the method for dredging according to the present invention which can be practiced by means of either one of the above-described dredging apparatuses in which the mud and sludge suction port member U is movable in the bow-stern direction, will be explained with reference to FIG. 8 showing the operation steps in a schematic plan view and FIG. 9 which shows the relation between the position of the suction port member U and the dredging efficiency during the dredging operations. It is also assumed in this example of dredging operations that the starboard spud is used as a working spud, while the port spud is used as an advancing spud, and the stroke of movement in the bow-stern directions of the suction port member U is twice as large as the length in the bow-stern directions of the opening at the mud and slurry inlet portion of the suction port member U.

Describing now the dredging work starting from the rightmost position $A_1$ on the starboard shown in FIG. 8, the starboard spud $S_1$ at the stern is driven into the bottom of the body of water while the port spud $S_2$ is kept retracted, and the suction port member U is located at the foremost position on the movable frame K.

Under this condition, when a leftward swing of the ladder L and the hull is effected, the suction port member U moves from the position $A_1$ to the position $B_1$ while tracing an arc-shaped locus having its center at the starboard spud $S_1$. At the position $B_1$ the swing motion is stopped, and after the port spud $S_2$ has been driven into the bottom of the sea, the starboard spud $S_1$ which has been held in the bottom of the sea is retracted.

Subsequently, when a further leftward swing is effected, the suction port member U tends to move from the position $B_1$ to the position $C_2$ while tracing an arc-shaped locus having its center at the advancing spud $S_2$.

However, while effecting the further leftward swing, the suction port member U is gradually shifted backwards or sternwards so that the suction port member U will be continuously shifted towards the stern a distance twice as large as the length in the bow-stern directions of the opening on the side surface of the suction port member U in accordance with the swing motion during the period when the suction port member moves from the position P of the spud on the starboard to the position Q of the spud on the port. Thus the suction port member U traces an arc-shaped locus from the position $B_1$ to the position $C_1$ rather than the position $C_2$.

During this period, the hull has advanced a distance twice as large as the length of the side opening of the suction port member U, and when the suction port member U comes to the position $C_1$, the suction port member U is located at the rearmost position on the movable frame K. At the position $C_1$, the swing motion is stopped, and after the spuds have been reversed, the leftward swing is resumed. Then the suction port member U moves from the position $C_1$ to the position $D_1$ while tracing an arc-shaped locus having its center at the starboard spud $S_1$.

When the suction port member U has reached the leftmost position $D_1$ on the port, the swing motion is stopped, and the suction port member U which has been located at the rearmost position on the movable frame K is shifted to the center position on the movable frame K. Then the suction port member U is located at the position $E_1$. Subsequently, when a rightward swing is effected, the suction port member U moves from the position $E_1$ through the positions $F_1$ and $G_1$ to the position $H_1$ while tracing an arc-shaped locus having its center at the starboard spud $S_1$.

When the suction port member U has reached the rightmost position $H_1$ on the starboard, the swing motion is stopped, and the suction port member U which has been located at the center position on the movable frame K is shifted to the foremost position on the movable frame. Then the suction port member U is located at the position $A_2$. Then a leftward swing is started from this position $A_2$, and the subsequent sequence of dredging operations is identical to the above-described sequence of operations which was started from the position $A_1$.

More particularly, between the positions $A_2$ and $B_2$ is effected a leftward swing about the starboard spud $S_1$ with the suction port member U at the foremost position on the movable frame K, and after the spuds have been reversed at the position $B_2$, between the positions $B_2$ and $C_2$ is effected a leftward swing about the port spud $S_2$ while the suction port member U which has been located at the foremost position on the movable frame K is gradually shifted towards the rearmost position, and during this period the hull is advanced a distance equivalent to the shift length in the bow-stern directions of the suction port member U.

After the spuds have been reversed at the position $C_2$, a leftward swing is effected about the starboard spud $S_1$, at the position $D_2$ the suction port member U is shifted from the rearmost position on the movable frame K to its center position, then the suction port member U moves from the position $E_2$ through the positions $F_2$ and $G_2$ to the position $H_2$ while effecting a rightward swing about the starboard spud $S_1$. At this point of the process the suction port member U is shifted from the center position to the foremost position.

By repeating the above-described sequence of operations, the hull is intermittently advanced while continuing the dredging work.

The relation between the position of the suction port member U and the dredging efficiency in the above-described sequence of operations, is diagrammatically shown in FIG. 9. In the dredging work, the shifts of the position of the suction port member U from $A_1 \rightarrow B_1 \rightarrow C_1 \rightarrow D_1 \rightarrow E_1 \rightarrow F_1 \rightarrow G_1 \rightarrow H_1 \rightarrow A_2$ are repeated, and so, only one cycle of the operations from the position $A_1$ to the position $A_2$ need be investigated.

In the method according to the present invention, it never occurs that an area where the dredging has been already finished is again passed over by the suction port member U resulting in suction of only water, as is the case with the prior art method, nor that during the period when the swing motion is being effected about the port spud $S_2$ the dredging efficiency is gradually varied from 0% to 100% and during that period a large amount of water is sucked.

More particularly, according to the present invention, during the periods when a swing motion is being effected ($A_1 \sim B_1$, $B_1 \sim C_1$, $C_1 \sim D_1$, $E_1 \sim F_1$ $G_1 \sim H_1$), the dredging effeciency is always equal to 100%. Suction of water occurs only when the swing motion is stopped for the purpose of reversing the spuds ($B_1$, $C_1$) and when the suction port member is being shifted towards the bow at the extreme positions on the starboard and on the port ($D_1 \sim E_1$, $H_1 \sim A_2$), and during these periods the dredging efficiency is equal to 0%. With such sequence of operations, the average value of the dredging efficiency is raised to as high as about 80%, and accordingly, the dredging efficiency is greatly improved in comparison to the average dredging efficiency of about 40% in the case of the prior art method.

While the starboard spud $S_1$ is used as a working spud and the port spud $S_2$ is used as an advancing spud in the above-described embodiments, the roles of the respective spuds could be reversed.

As a practical method for gradually shifting the suction port member U along the movable frame K while the suction port member U is moving from the position $B_1$ to the position $C_1$ in FIG. 8, the following means are known.

(1) Method for detecting the swing angle from the number of revolutions of a swing winch Since the swing angle of the hull is substantially proportional to the number of revolutions of the wire drum of the swing winch, the amount of shift of the suction port member U is controlled in accordance with the number of revolutions of the swing winch starting from the time when the suction port member U comes to the position $B_1$.

(2) Method for detecting the swing angle with a magnetic compass

On a magnetic compass are preset the angles for alternately reversing the spuds, and the amount of shift of the suction port member U is controlled in accordance with the swing angle of the hull.

The effects and advantages of the method for dredging according to the present invention as well as the dredging apparatus to be used in said method are enumerated in the following:

(1) When a dredging pump of the same capacity is used, the amount of the mud and sludge dredged from the bottom is increased. Expressed in a reversed manner, when the same amount of mud and sludge is to be dredged, according to the method of the present invention, a smaller pump capacity than in the prior art method will suffice, and so, both the initial investment and the running cost are reduced.

(2) When using the dredged mud and sludge for reclamation, in order to prevent public nuisance it is necessary to carry out water processing (removal of floating and suspended solid particles, harmful substance, etc.) before the excessive sucked water is discharged. However, according to the present invention, since the amount of excessive sucked water is small in comparison to the prior art method, only a small amount of water processing is required.

(3) When transporting the dredged mud and sludge to the reclaimed ground, there are different ways of transportation such as pipe line transportation, transportation by a sludge transport ship, etc. However, in any such way, the mud and sludge dredged by the method according to the present invention contains a smaller amount of excessive sucked water in comparison to the mud and sludge dredged by the prior art method, and therefore, the amount of transportation required is smaller.

(4) Since the suction port member U is mounted by a truck 5 on the movable frame K pivotably mounted on the extreme end portion of the ladder so as to be movable in the back and forth directions, the operation of the suction port member U can be effected precisely and smoothly.

(5) In a modified embodiment in which the suction port member U is pivotably mounted on the movable frame K on a parallel link mechanism 25 and 26, the structure is simple and the maintenance is easy.

What is claimed is:

1. A method for dredging, comprising:

driving one spud of a pair of spuds provided on the respective sides of the stern of a dredger into the bottom of a body of water, said spud being on one side of the stern;

carrying out a cycle of steps comprised of:

swinging a ladder projecting from the bow of the dredger and the hull about the spud driven into the bottom while dredging through a suction port member that is mounted at the free end of said ladder so as to be movable sternward and forward in the bow-stern direction of said hull as said ladder is swinging in the direction from one side through a first portion of the side to side path of movement of the suction port member with said suction port member disposed at the forwardmost position of its stroke:

then at the end of the first portion of said path, driving the spud on the other side into the bottom and retracting the spud on said one side;

further dredging while swinging said ladder and hull in the directon from said one side toward said other side about the spud on said other side through a second portion of said path while simultaneously gradually retracting said suction port member from the forwardmost position of the stroke thereof to the most sternward position;

at the end of the second portion of said path, driving the spud on said one side into the bottom and retracting the spud on said other side;

further dredging while swinging said ladder and hull in the direction from said one side towards said other side about the spud on said one side through the remainder of said path;

at the end of said swinging movement, moving said suction port member in the forward direction to the middle of the stroke;

thereafter dredging while swinging said ladder and said hull along the entire path towards said one side; and at the end of said last-mentioned swinging movement, advancing said suction port member to the forwardmost position of its stroke; and thereafter repeating said cycle of steps.

2. A dredging apparatus comprising: a hull; a ladder projecting from the bow of said hull and freely pivotable around a horizontal axis for being inclined up and down; a movable frame rotatably mounted on the free end of said ladder for rotation about a horizontal lateral axis; a truck mounted on said movable frame for movement forward and sternward along said frame in the bow-stern direction of said hull; a suction port member rigidly mounted on said truck for movement with said truck; frame moving means connected to said movable frame for moving said frame around said horizontal axis for keeping said frame in a horizontal position regardless of the inclination of the ladder; and a truck moving means connected to said truck for moving said truck in said forward and sternward movement.

3. A dredging apparatus comprising: a hull; a ladder projecting from the bow of said hull and freely pivotable around a horizontal axis for being inclined up and down; a movable frame rotatably mounted on the free end of said ladder for rotation about a horizontal lateral axis; a parallel link mechanism mounted on said frame for rocking movement in the forward and sternward direction along said frame in the bow-stern direction of said hull; a suction port member rigidly mounted on said link mechanism for movement with said link mechanism; frame moving means connected to said movable frame for moving said frame around said horizontal axis for keeping said frame in a horizontal position regardless of the inclination of the ladder; and a link mechanism moving means connected to said link mechanism for moving said link mechanism in said rocking movement.

* * * * *